US010729265B2

(12) United States Patent
High et al.

(10) Patent No.: US 10,729,265 B2
(45) Date of Patent: Aug. 4, 2020

(54) SECURE STORAGE ASSEMBLY APPARATUS FOR DELIVERY OF FRESH, PERISHABLE OR ENVIRONMENTALLY SENSITIVE GOODS AND OTHER GOODS

(71) Applicant: Nurdwerx LLC, Pacific Grove, CA (US)

(72) Inventors: Jeremy High, Pacific Grove, CA (US); Joshua Bauman, Monterey, CA (US); Philip Ciszek, Monterye, CA (US)

( * ) Notice: Subject to any disclaimer, the term of this patent is extended or adjusted under 35 U.S.C. 154(b) by 72 days.

(21) Appl. No.: 16/126,883

(22) Filed: Sep. 10, 2018

(65) Prior Publication Data

US 2019/0282015 A1 Sep. 19, 2019

Related U.S. Application Data

(60) Provisional application No. 62/562,074, filed on Sep. 22, 2017.

(51) Int. Cl.
*A47G 29/14* (2006.01)
*A47G 29/20* (2006.01)

(52) U.S. Cl.
CPC ..... *A47G 29/141* (2013.01); *A47G 29/20* (2013.01); *A47G 2029/142* (2013.01); *A47G 2029/146* (2013.01); *A47G 2029/147* (2013.01)

(58) Field of Classification Search
CPC ..... A47G 29/141; A47G 29/20; A47G 2029/142; A47G 2029/146; A47G 2029/147; A47G 2029/149; F25D 23/10
USPC ..... 232/19, 43.1, 43.4, 44, 1 E; 49/68; 220/476, 477; 62/263; 312/242, 401
See application file for complete search history.

(56) References Cited

U.S. PATENT DOCUMENTS 2,579,379 A * 12/1951 Fritsche ..... F25D 23/10 62/263
3,708,997 A * 1/1973 McLaughlin ..... F25D 19/00 62/449
4,024,729 A * 5/1977 Abate, Sr. ..... A47G 29/28 62/263
5,774,053 A * 6/1998 Porter ..... A47G 29/141 232/19
5,979,750 A * 11/1999 Kindell ..... A47G 29/141 232/1 R
6,079,216 A * 6/2000 de Marsillac Plunkett ..... A47G 29/20 109/7
6,204,763 B1 * 3/2001 Sone ..... A47G 29/141 221/2
6,220,049 B1 * 4/2001 Lajeunesse ..... B60P 3/36 312/287
6,415,552 B1 * 7/2002 Khosropour ..... A47G 29/141 232/1 E
6,426,699 B1 * 7/2002 Porter ..... A47F 10/00 221/2
8,063,735 B2 * 11/2011 Shoenfeld ..... A61B 50/10 340/5.73
10,238,210 B1 * 3/2019 Shoenfeld ..... A47B 67/02
(Continued)

*Primary Examiner* — William L Miller
(74) *Attorney, Agent, or Firm* — Antero Tormey Petrin; Pete Tormey

(57) ABSTRACT

A secure storage assembly apparatus for the delivery of fresh, perishable or environmentally sensitive goods and other goods to a customer's home or business premises while not at home or work and a method of installing same to a structure are disclosed in accordance with the present disclosure and figures herein.

5 Claims, 21 Drawing Sheets

(56) References Cited

U.S. PATENT DOCUMENTS

| | | | | |
|---|---|---|---|---|
| 2004/0084276 | A1* | 5/2004 | Repic | B65G 11/20 193/34 |
| 2007/0152076 | A1* | 7/2007 | Chiang | F25D 29/00 236/94 |
| 2008/0047287 | A1* | 2/2008 | Ruppert | F25D 29/00 62/256 |
| 2008/0295529 | A1* | 12/2008 | Kawaguchi | F25B 49/022 62/126 |
| 2013/0111936 | A1* | 5/2013 | Olson | F25D 23/028 62/127 |
| 2014/0165614 | A1* | 6/2014 | Manning | F25D 29/00 62/62 |

* cited by examiner

SECURE STORAGE ASSEMBLY APPARATUS FOR DELIVERY OF FRESH, PERISHABLE OR ENVIRONMENTALLY SENSITIVE GOODS AND OTHER GOODS

PRIORITY

This application claims the benefit of provisional patent application 62/562,074 filed Sep. 22, 2017 by the same inventors which is incorporated by reference as if fully presented herein.

TECHNICAL FIELD

The present disclosure relates to the field of storage apparatus for delivery of goods, and more particularly, to a secure storage assembly apparatus for the delivery of fresh, perishable or environmentally sensitive goods and other goods to a customer's home, dwelling, or business premises while not at home or work.

BACKGROUND

In today's rapidly growing e-commerce environment, it is very common for customers to order food and other goods for delivery to the home or business from retailers who are based far away and/or are local. Shipping delivery carriers, such as UPS, deliver an average of 15 million packages each day to customers worldwide, and online retailers, such as Amazon, ship about 1.8 million packages each day worldwide. Customers worry about package theft when such packages are left unattended at their home or business. Conventional approaches for delivery of goods have failed to solve the issue of in home or work secure delivery of environmentally sensitive goods and other goods to customers' home or work premises. It would thus be desirable to have an improved storage assembly apparatus for the delivery of environmentally sensitive goods and other goods, among other desirable features as described herein, which avoids the disadvantages of conventional storage apparatus.

SUMMARY

In a first aspect, there is provided herein a secure storage assembly apparatus for the delivery of goods to a premises. The apparatus includes an exterior insulated door configured to have a locking mechanism and opened from an exterior of the premises. An exterior insulated sleeve has an inner surface with an upper flange and a lower flange extending outwardly therefrom. The exterior insulated sleeve has an outer surface for receiving the exterior insulated door thereon. At least one flashing panel is configured to be attached to the upper flange and the lower flange of the exterior insulated sleeve. A drip edge is positioned thereunder the at least one hollow flashing panel. The apparatus further includes a hollow mount box having a weatherproof gasket extending therearound an outer surface thereof. The hollow mount box is configured to be attached to the premises. An interior insulated sleeve is configured to house at least one environmental control mechanism. At least one perforated sleeve platform is configured to cover the at least one environmental control mechanism disposed in the interior insulated sleeve. An interior insulated door is configured to be received on an outer surface of the interior insulated sleeve such that the interior insulated door is opened from the interior of the premises. The hollow mount box is configured to receive the exterior insulated sleeve at a first end and the interior insulated sleeve at a second end with the at least one flashing panel disposed between the hollow mount box and the exterior insulated sleeve when installed to the premises.

In certain embodiments, the exterior insulated sleeve is connected to the interior insulated sleeve with the hollow mount box secured therebetween via a plurality of fastening screws for tamper-proof security.

In certain embodiments, the hollow mount box is secured to a plurality of wall studs of an exterior wall of the premises via a plurality of fin screws.

In a second aspect, there is provided herein a method of installing a secure storage assembly apparatus to a structure. The method includes the steps of: providing the secure storage assembly apparatus disclosed herein in an unassembled configuration; designating a structure to install the secure storage assembly apparatus thereto; determining a hole cut of a designated area of an exterior wall of the structure as a stud or block frame; cutting the designated area of the exterior wall of the structure to accommodate the secure storage assembly apparatus to be installed thereto; securing the hollow mount box to a plurality of wall studs of the exterior wall of the structure; installing the exterior insulated sleeve with the exterior insulated door thereon and the at least one flashing panel in direct communication therewith around the first end of the hollow mount box; installing the interior insulated sleeve with the at least one environmental control mechanism disposed therein and the interior insulated door thereon around the second end of the hollow mount box; connecting the exterior insulated sleeve to the interior insulated sleeve with the hollow mount box secured therebetween via a plurality of fastening screws; and setting the at least one perforated sleeve platform over the at least one environmental control mechanism.

In certain embodiments, the method further includes the step of providing a transformer to connect the secure storage assembly apparatus to a power source.

Various advantages of this disclosure will become apparent to those skilled in the art from the following detailed description, when read in light of the accompanying drawings.

DETAILED DESCRIPTION

Figure 1:
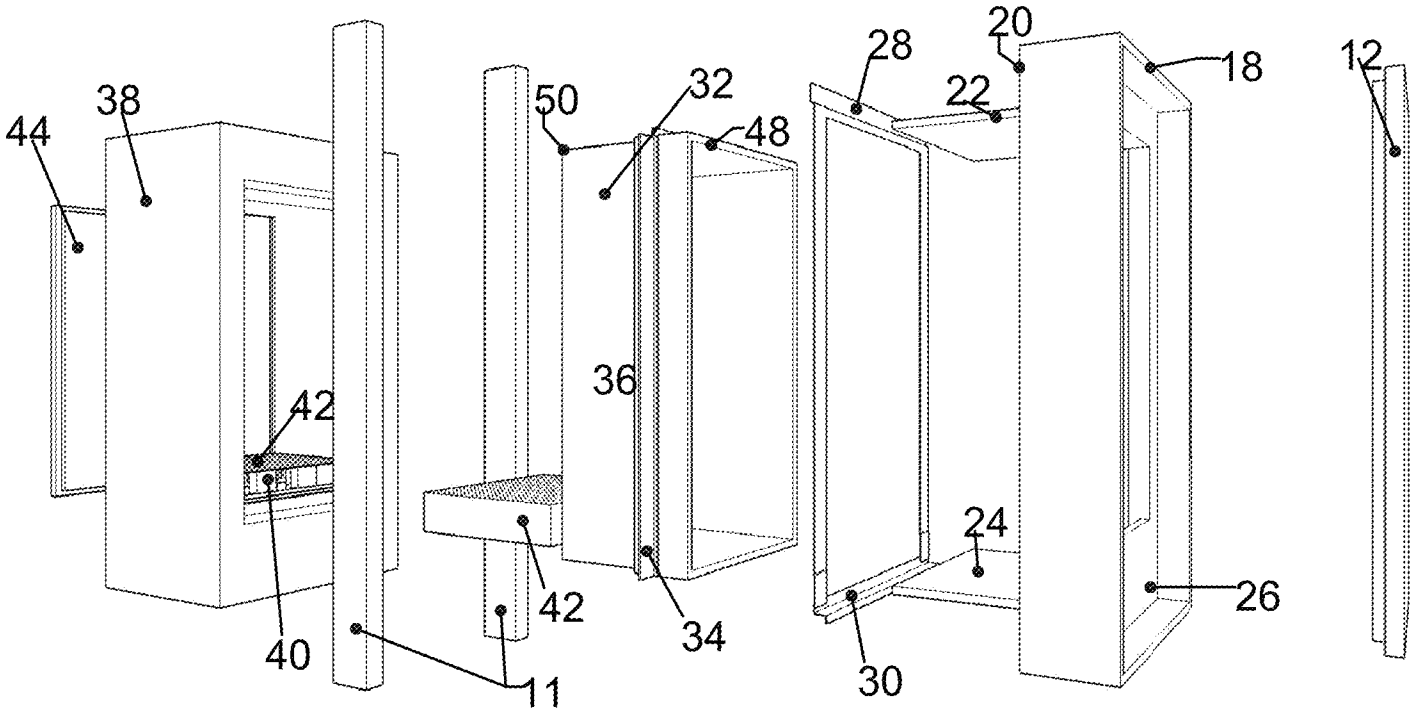
FIG. 1 is an exploded view of a secure storage assembly apparatus shown unassembled in accordance with an example embodiment of the present disclosure.
Figure 2:
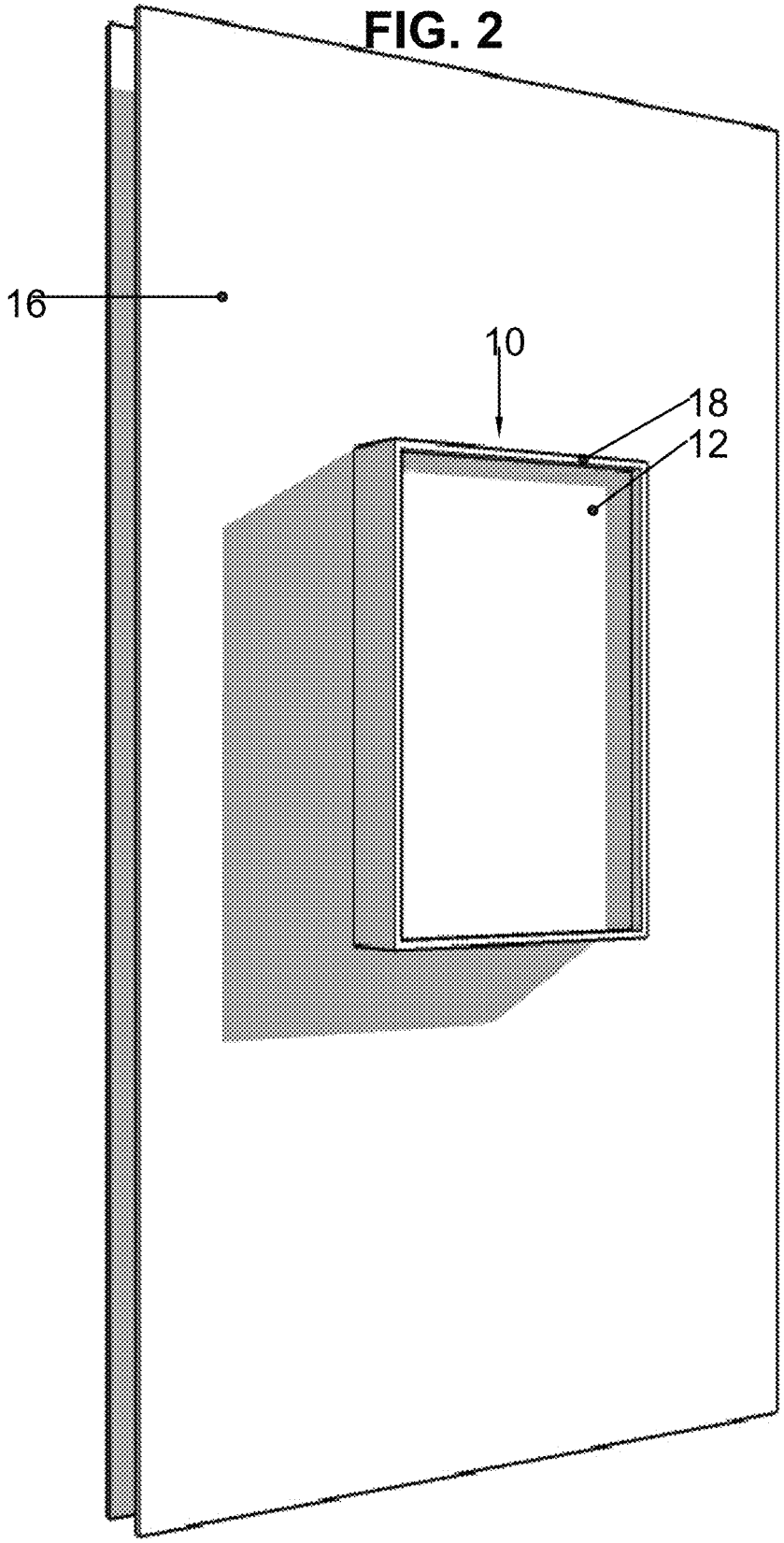
FIG. 2 is a front perspective view of the secure storage assembly apparatus of FIG. 1 shown assembled and attached to a structure in accordance with an example embodiment of the present disclosure.
Figure 3:
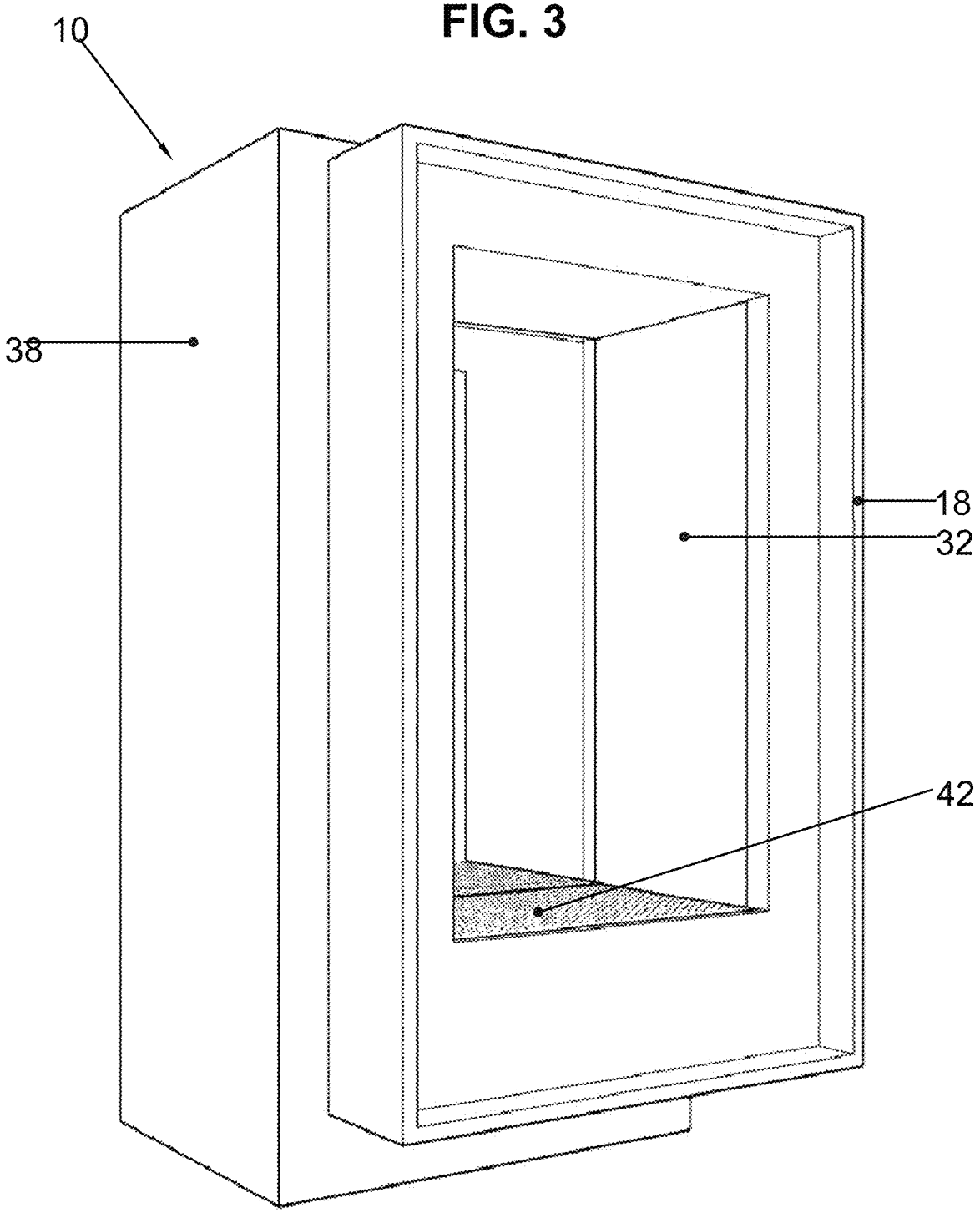
FIG. 3 is a front perspective view of the secure storage assembly apparatus of FIG. 2 shown without the exterior door in accordance with an example embodiment of the present disclosure.

This disclosure is not limited to the particular apparatus, systems, methodologies or protocols described, as these may vary. The terminology used in this description is for the purpose of describing the particular versions or embodiments only and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All sizes recited in this document are by way of example only, and the disclosure is not limited to structures having the specific sizes or dimensions recited below. As used herein, the term "comprising" means "including, but not limited to."

In consideration of the figures, it is to be understood for purposes of clarity that certain details of construction and/or operation are not provided in view of such details being conventional and well within the skill of the art upon disclosure of the document described herein. The present disclosure pertains to an environmentally controlled, secure storage assembly apparatus that is permanently installed to a premises or structure, such as a home or business, for the delivery of fresh, perishable or environmentally sensitive goods and other goods, such as standard parcels and high value deliverables, to a customer's home or business premises while not at home or work. The secure storage assembly apparatus combines a solution set of security, environmental control (temperature and humidity), wireless, remote and automated access by delivery persons, drones and robots while being weatherproof and secure for the customer inside his or her home or business for receipt of the delivered goods at the customer's convenience. The environmental control includes use of an efficient and practical vapor-compression refrigeration system as a reversing heat pump and a permanently connected and factory charged thermal conditioning module. Further, the secure storage assembly apparatus is fully upgradeable (physical components as well as any software updates), can be professionally installed in an efficient manner, includes patch-free installation sleeves, is aesthetically pleasing as a floating unit that allows minimal disturbances to the home or business, and provides easy clean up underneath and 360 degrees or a half dome of ventilation inside and out.

In addition to the advantages described above, the secure storage assembly apparatus is configured to fit all building envelopes with weather tight certainty and does not require any patching of the building or structure. The secure storage assembly apparatus takes into design consideration wall thicknesses, climates, and incremental heavy weather and seasons.

Referring now to FIGS. 1-5, the secure storage assembly apparatus 10 will be described in more detail. The apparatus generally includes an exterior insulated door (or portal) 12 configured to have a locking mechanism (not shown) and opened from an exterior 14 of the premises 16. The exterior insulated door 12 can be hinged and latched (not shown) with the locking mechanism. An exterior insulated sleeve 18 has an inner surface 20 with an upper flange 22 and a lower flange 24 extending outwardly therefrom. The exterior insulated sleeve 18 has an outer surface 26 for receiving the exterior insulated door 12 thereon. The exterior insulated sleeve 18 can include a plurality of perforations (not shown) to allow water to exit therefrom. At least one flashing pane 128 is configured to be attached to the upper flange 22 and the lower flange 24 of the exterior insulated sleeve 18. A drip edge 30 is positioned thereunder the at least one hollow flashing panel 28.

The apparatus further includes a hollow mount box 32 having a weatherproof gasket 34 extending therearound an outer surface 36 of the hollow mount box. The hollow mount box 32 is configured to be permanently attached to the premises 16, but can be removed from the premises if necessary. An interior insulated sleeve 38 is configured to house at least one environmental control mechanism 40. At least one perforated sleeve platform 42 is configured to cover the at least one environmental control mechanism 40 disposed in the interior insulated sleeve 38. An interior insulated door (or portal) 44 is configured to be received on an outer surface 46 of the interior insulated sleeve 38 such that the interior insulated door 44 is opened from the interior (not shown) of the premises 16. The hollow mount box 32 is configured to receive the exterior insulated sleeve 18 at a first end 48 and the interior insulated sleeve 38 at a second end 50 with the at least one flashing panel 28 disposed between the hollow mount box 32 and the exterior insulated sleeve 18 when installed to the premises 16.

In some embodiments, the exterior insulated sleeve 18 is connected to the interior insulated sleeve 38 with the hollow mount box 32 secured therebetween via a plurality of fastening screws 45 (FIG. 4) for tamper-proof security. For example, at least four 18 inch screws 45 can connect the interior insulated sleeve 38 to the exterior insulated sleeve 18 through the hollow mount box 32, so they are water tight and not exposed to the elements or tampering. A weld or adhesive may be disposed at the site of the fastening screws 45.

In some embodiments, the hollow mount box 32 is secured to a plurality of wall studs 11 of an exterior wall 14 of the premises 16 via a plurality of fin screws 9.

In other embodiments, the locking mechanism remotely opens the exterior insulated door 18 through pop latch release and is auto-timed to close with a pressure sensor to detect a body part (i.e., an arm) or a bulging package. The delivery person can tap the exterior insulated door 18 so it will self-close and provide sound and light indicators of a successful lock.

In further embodiments, the secure storage assembly apparatus lock 10 can be configured to include a telescoping tray (not shown) to accept delivery of goods via drones or robots (not shown).

Figure 4:
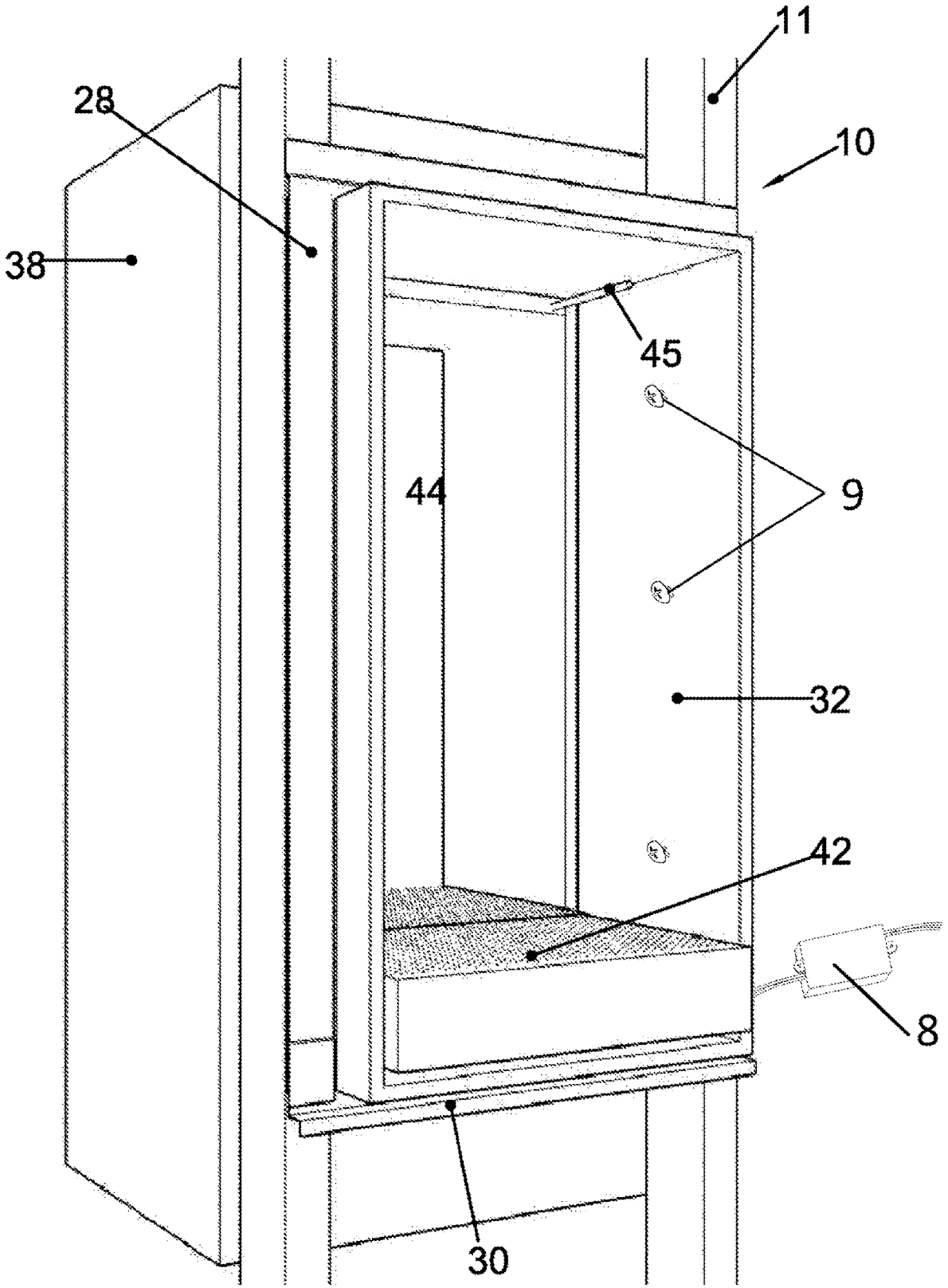
FIG. 4 is a front perspective view of the secure storage assembly apparatus of FIG. 3 shown without the exterior sleeve and exterior door in accordance with an example embodiment of the present disclosure.
Figure 5:
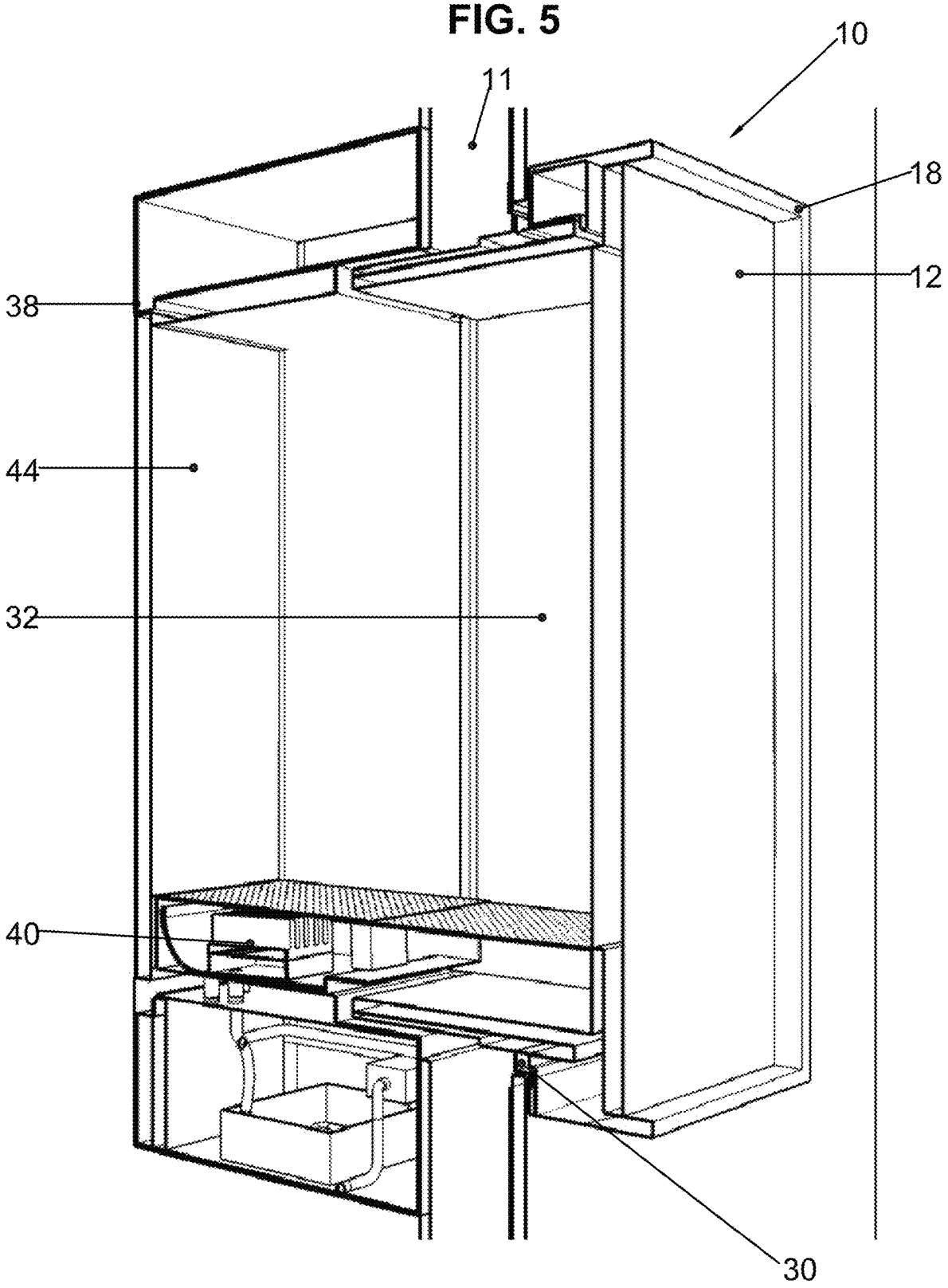
FIG. 5 is an x-ray perspective view of the secure storage assembly apparatus of FIG. 1 shown assembled and attached to a structure in accordance with an example embodiment of the present disclosure.
Figure 6:
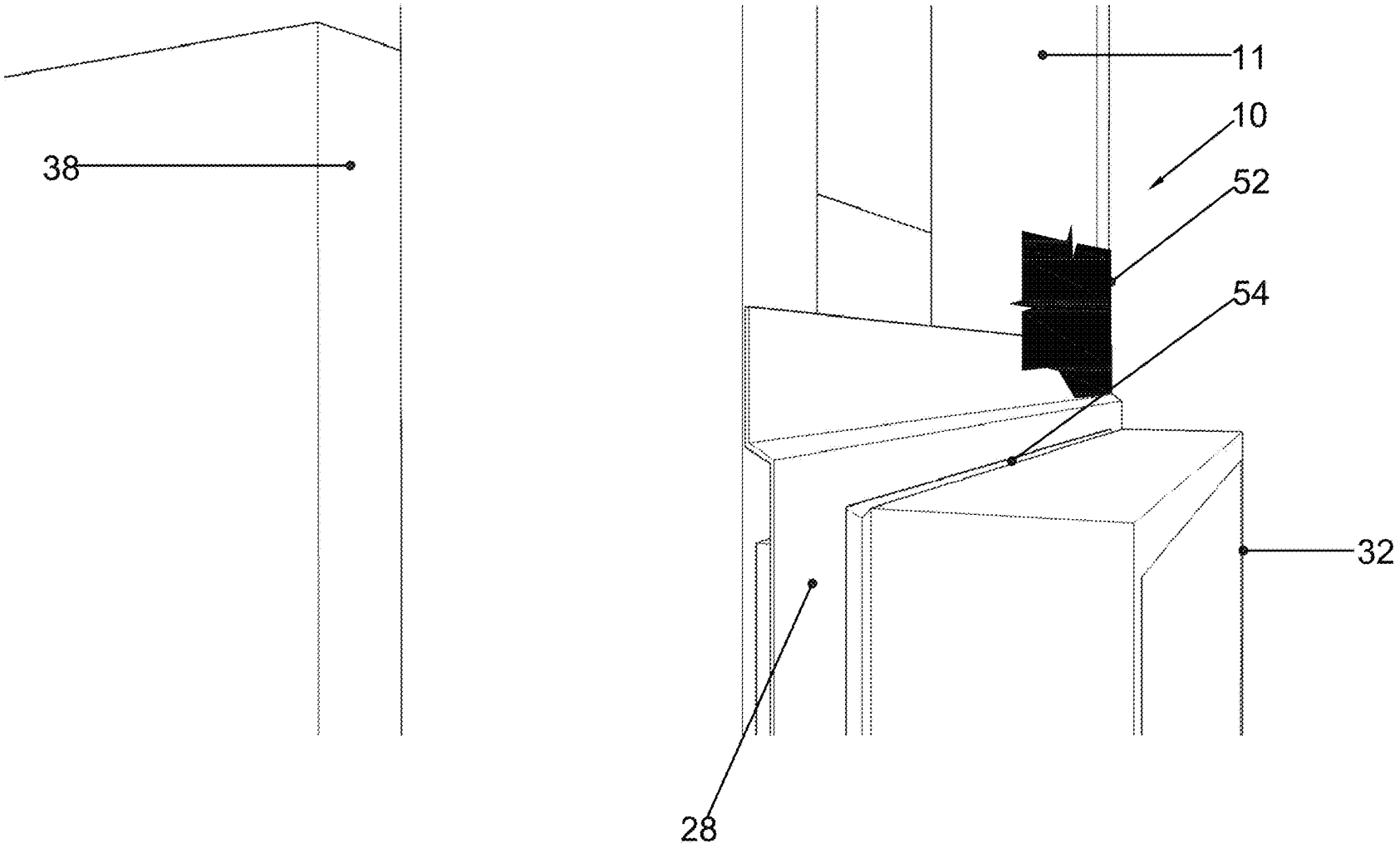
FIG. 6 is an enlarged, partial side perspective view of the secure storage assembly apparatus of FIG. 4 showing the upper flashing interchange with mount box in accordance with an example embodiment of the present disclosure.

FIG. 6 is an enlarged, partial side perspective view of the secure storage assembly apparatus 10 of FIG. 4 showing the upper flashing panel 28 interchange with the hollow mount box 32. As shown in the illustrated embodiment, building paper 52 on the wall studs laps over the upper flashing panel 28 and a drip channel 54 directs moisture from the building paper 52 and upper flashing panel 28 over the edge of the hollow mount box 32 and down to the drip edge and weeps (not shown) below.

Figure 7:
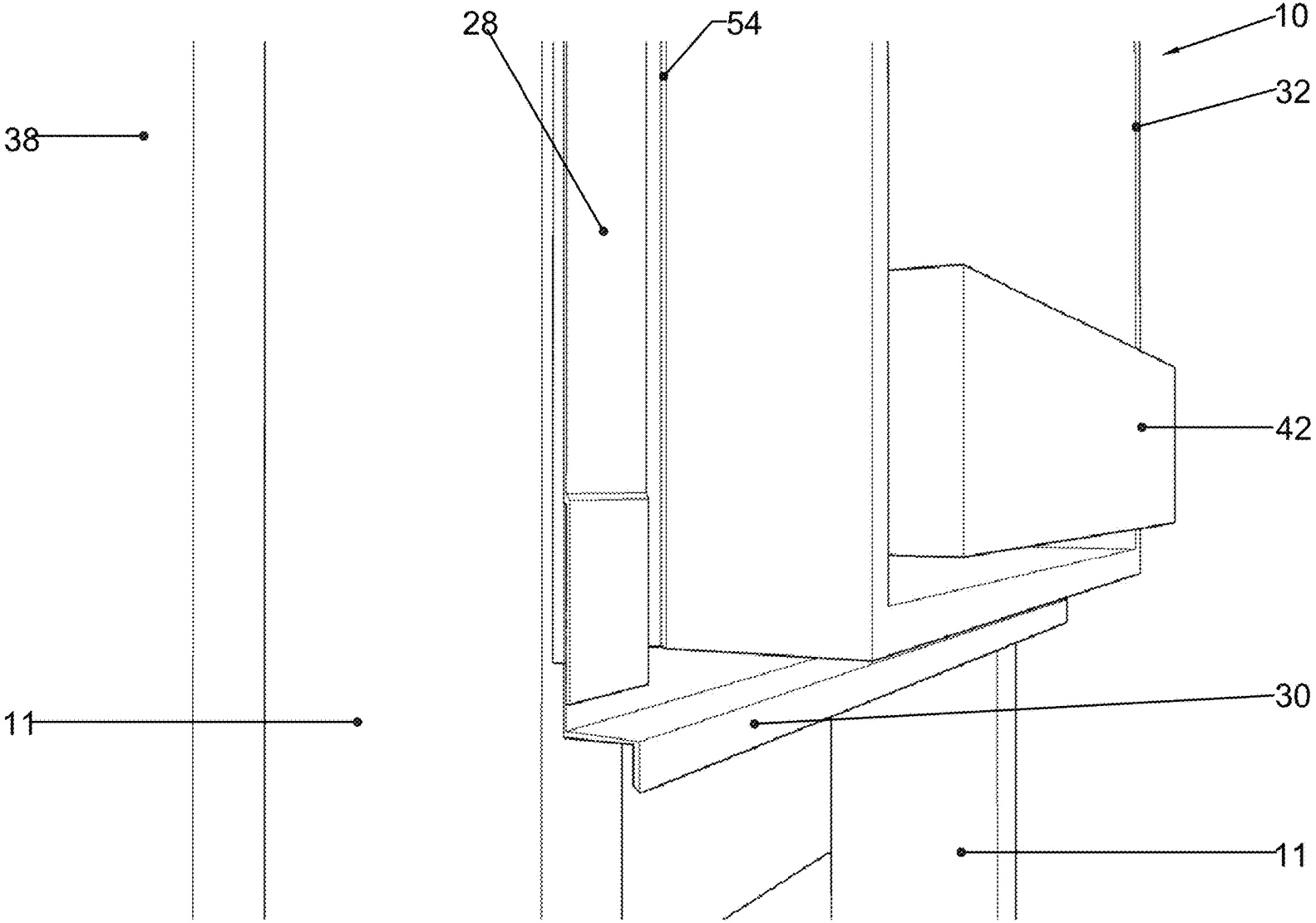
FIG. 7 is an enlarged, partial side perspective view of the secure storage assembly apparatus of FIG. 4 showing the lower flashing interchange with mount box in accordance with an example embodiment of the present disclosure.
Figure 8:
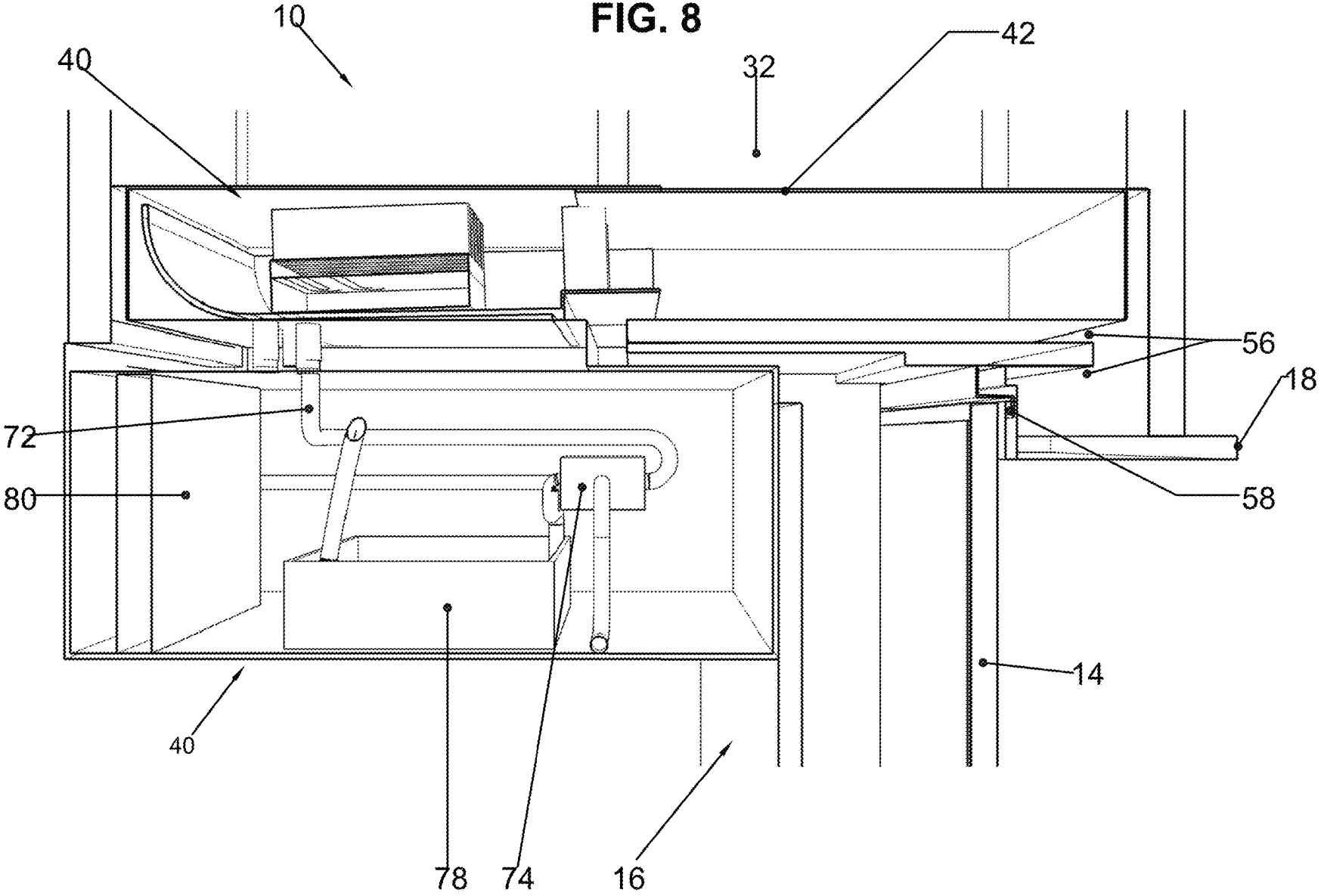
FIG. 8 is a section view of the secure storage assembly apparatus showing the lower portion thereof housing the environmental control mechanism in accordance with an example embodiment of the present disclosure.
Figure 9:
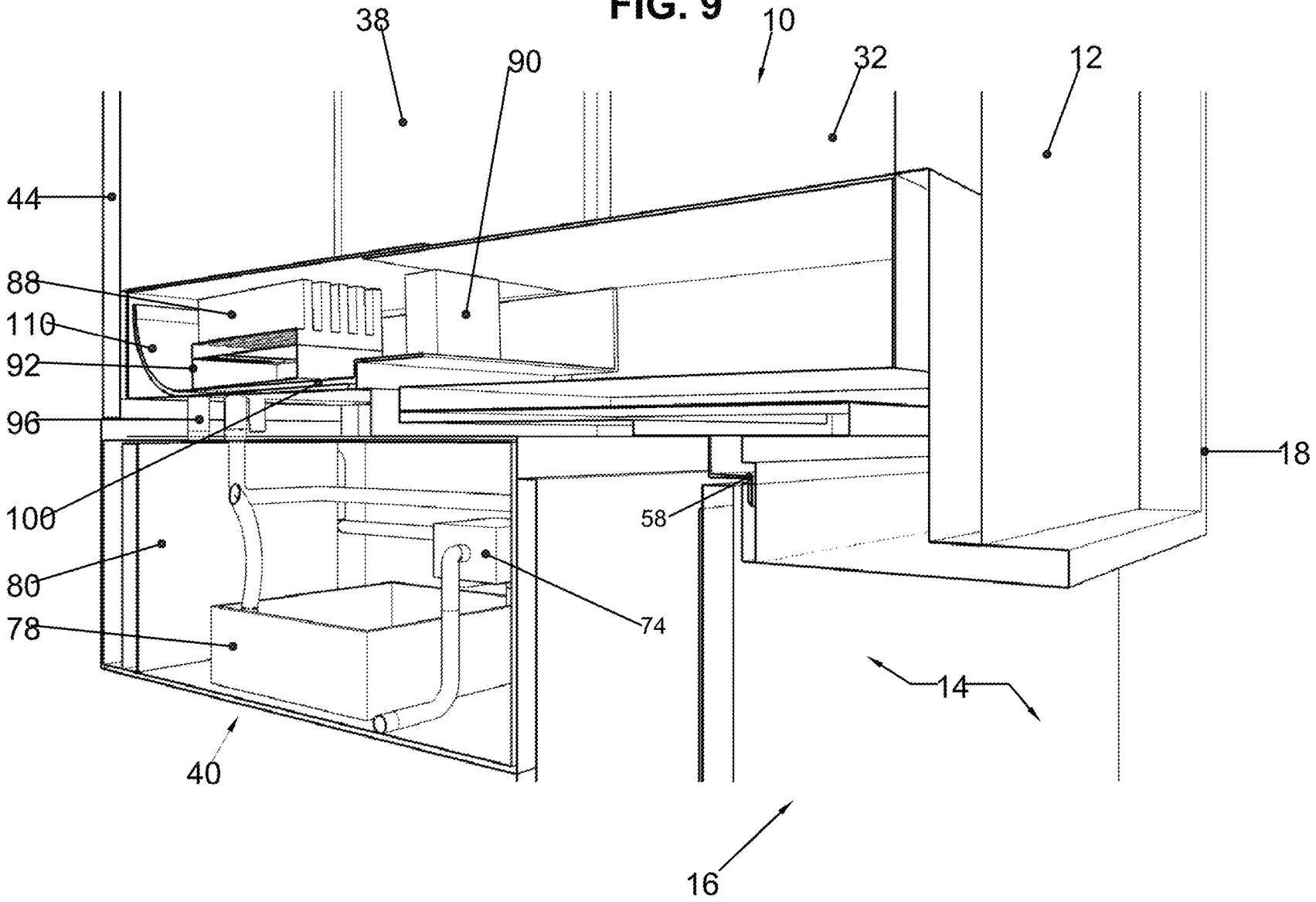
FIG. 9 is a section view of the secure storage assembly apparatus showing the lower portion thereof in perspective housing the environmental control mechanism in accordance with an example embodiment of the present disclosure.

FIG. 7 is an enlarged, partial side perspective view of the storage assembly apparatus 10 of FIG. 4 showing the lower flashing panel 28 interchange with the hollow mount box 32. As shown in the illustrated embodiment, the flashing pane 128 (shown as a snap-in, two-piece component) directs moisture from the building paper 52 (FIG. 6) around the hollow mount box 32 and down the drip channel 54 to the drip edge 30 through sleeve weeps (not shown) below. FIG. 8 is a section view of the secure storage assembly apparatus 10 showing the lower portion thereof housing the environmental control mechanism 40. FIG. 9 is a section view of the secure storage assembly apparatus 10 showing the lower portion thereof in perspective housing the environmental control mechanism 40. As shown in the illustrated embodiments, the perforated sleeve platform 42 covering the environmental control mechanism 40 functions as a vent through which conditioned air enters the secure storage assembly apparatus 10. The perforated sleeve platform 42 can be fabricated in two pieces to allow telescoping of the secure storage assembly apparatus 10 depending on wall thickness. The dimensions of the perforated sleeve platform 42 can be such to accommodate the maximum and minimum depth of the secure storage assembly apparatus 10 depending on wall thickness. The exterior insulated sleeve 18 can include a slip-on notch 56 to allow for ease in connectivity to the hollow mount box 32. Foam connection pad 58 on the inner surface 20 of the exterior insulated sleeve 18 compresses against the exterior siding 14 to provide a moisture seal regardless of the siding texture of the premises 16.

Figure 10:
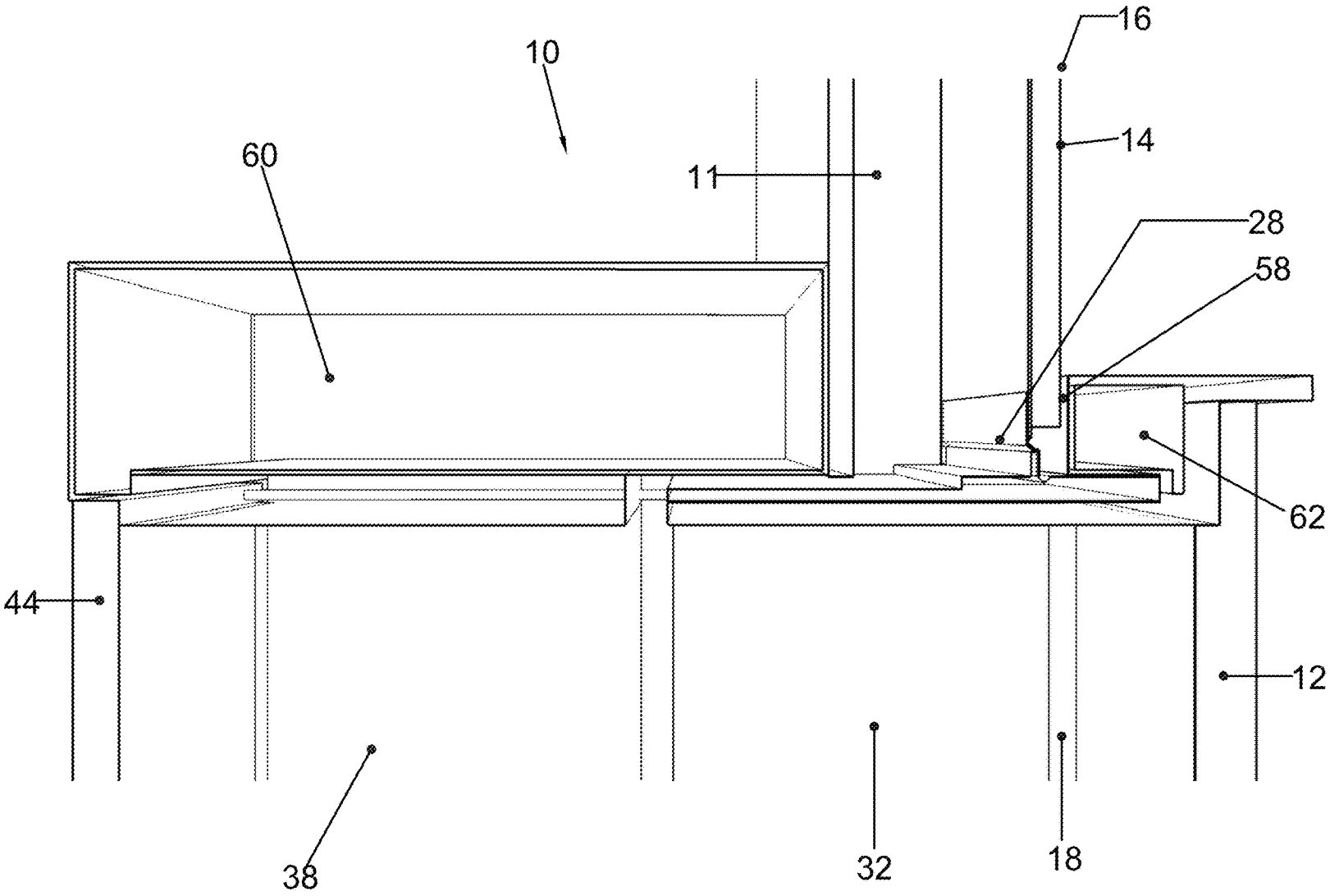
FIG. 10 is a section view of the secure storage assembly apparatus showing the upper portion thereof in accordance with an example embodiment of the present disclosure.
Figure 11:
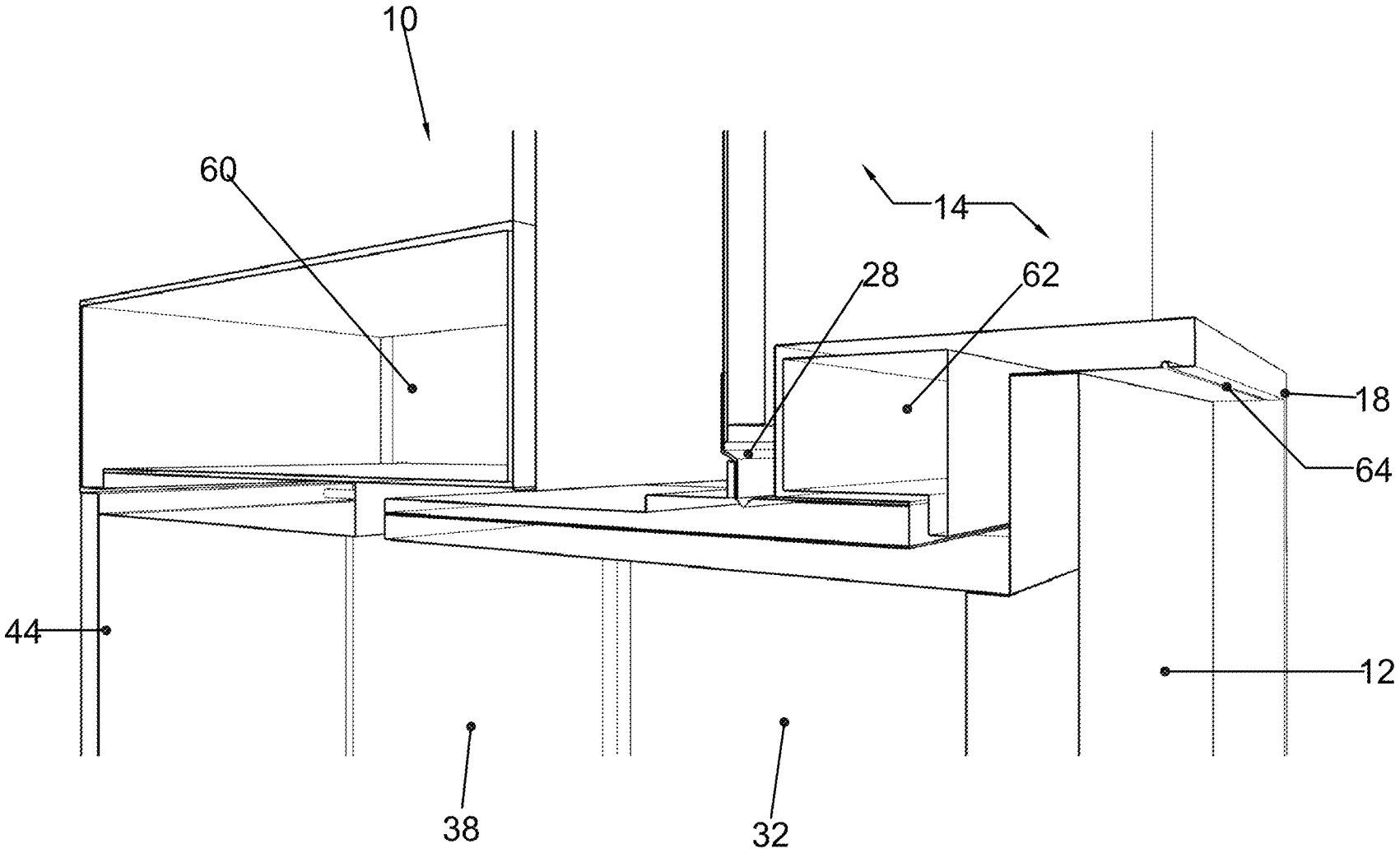
FIG. 11 is a section view of the secure storage assembly apparatus showing the upper portion thereof in perspective in accordance with an example embodiment of the present disclosure.
Figure 12:
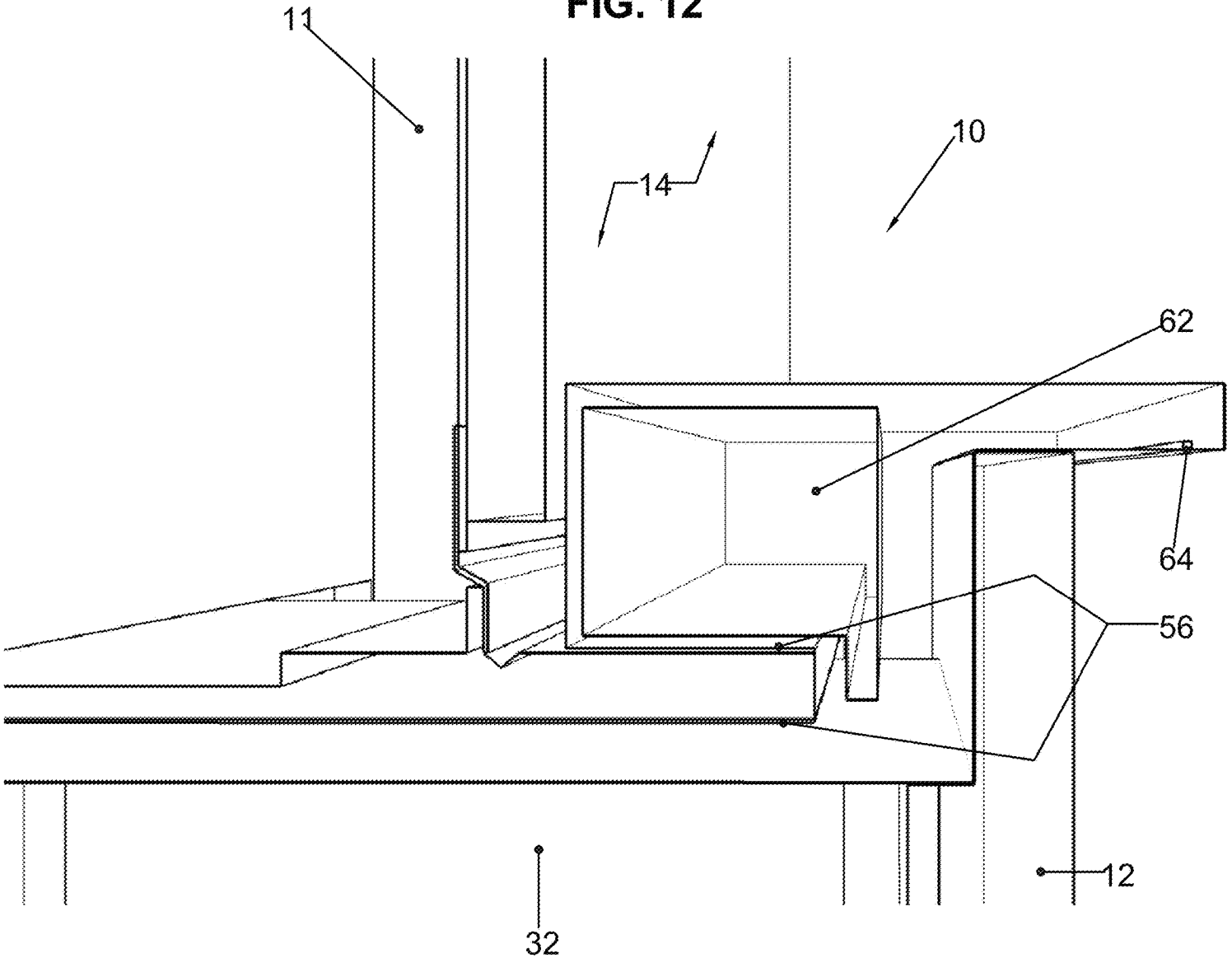
FIG. 12 is a section view of the secure storage assembly apparatus showing the upper portion thereof at the exterior insulated sleeve in accordance with an example embodiment of the present disclosure.

FIG. 10 is a section view of the secure storage assembly apparatus 10 showing the upper portion thereof. FIG. 11 is a section view of the secure storage assembly apparatus 10 showing the upper portion thereof in perspective. FIG. 12 is a section view of the secure storage assembly apparatus 10 showing the upper portion thereof at the exterior insulated sleeve 18. As shown in the illustrated embodiments, an upper cavity 60 of the interior insulated sleeve 38 can be used to house computer components (not shown) for use in conjunction with the secure storage assembly apparatus 10. An upper cavity 62 of the exterior insulated sleeve 18 can be used to house wirelessly controlled sensory and access components (not shown), such as temperature sensors, Wi-Fi, Bluetooth and other controls for use in conjunction with the secure storage assembly apparatus 10. Foam connection pad 58 compresses against the exterior siding 14 to provide a moisture seal regardless of the siding texture of the premises 16. Exterior insulated sleeve 18 includes a slip-on notch 56 to allow for ease in connectivity to the hollow mount box 32. A recessed notch 64 at the upper portion 66 of the exterior insulated sleeve 18 serves as an upper drip edge.

Figure 13:
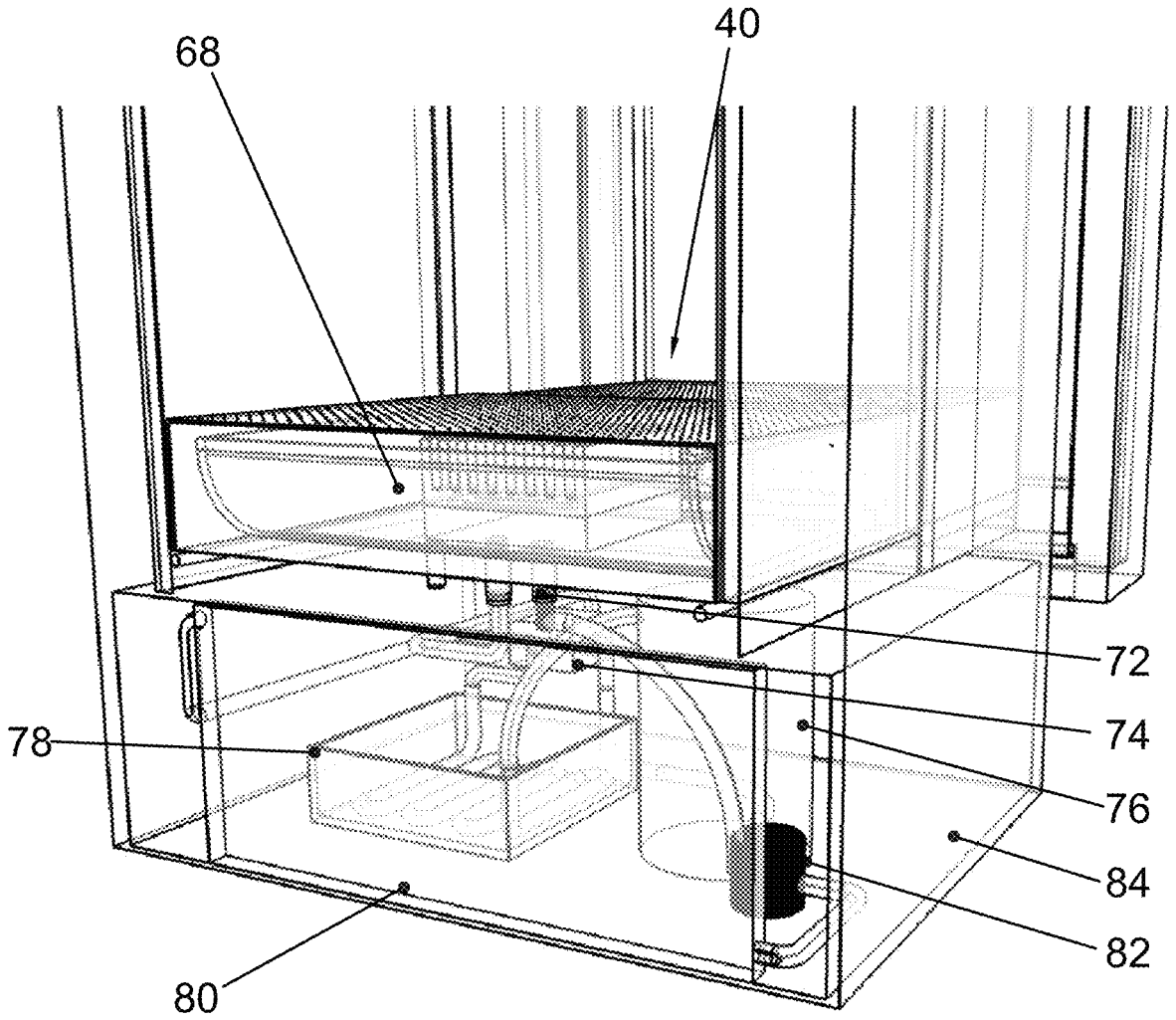
FIG. 13 is a section view of the environmental control mechanism of the secure storage assembly apparatus shown in perspective in accordance with an example embodiment of the present disclosure.

FIG. 13 is a section view of the environmental control mechanism 40 of the secure storage assembly apparatus 10 shown in perspective. As shown in the illustrated embodiment, the environmental control mechanism 40 includes the following thermal system configuration: a module operating position 68, a module shipping position 70, flex lines 72 to conditioning module (not shown), a reversing valve 74, a small hermetic refrigeration compressor 76, a drip pan 78 with compressor discharge directed to the bottom thereof to evaporate condensate, a finned tube heat exchanger 80, and a capillary tube to serve as a bi-directional expansion valve 82.

Figure 14:
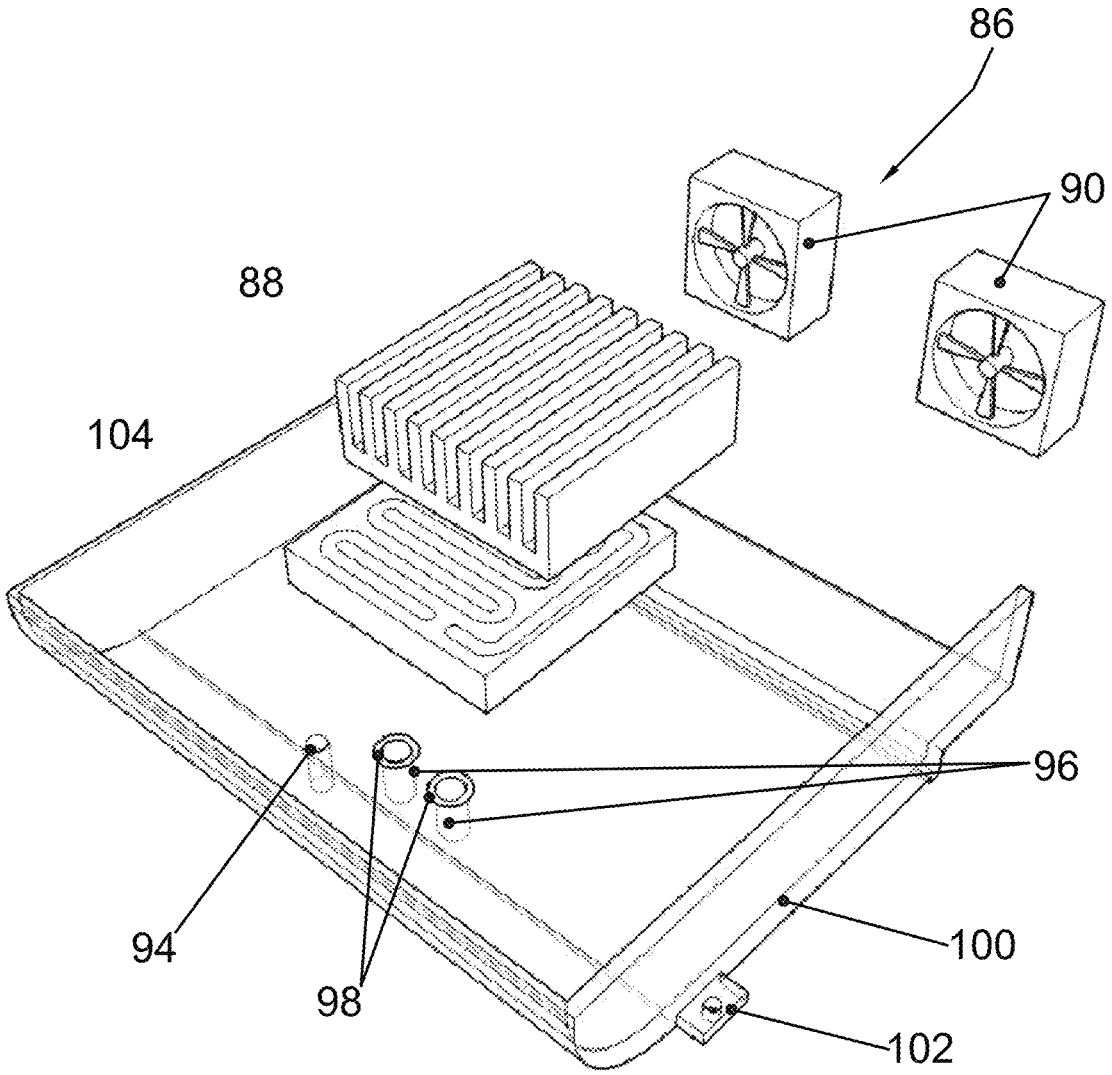
FIG. 14 is an exploded view of the thermal conditioning module of the environmental control mechanism of the secure storage assembly apparatus in accordance with an example embodiment of the present disclosure.
Figure 15:
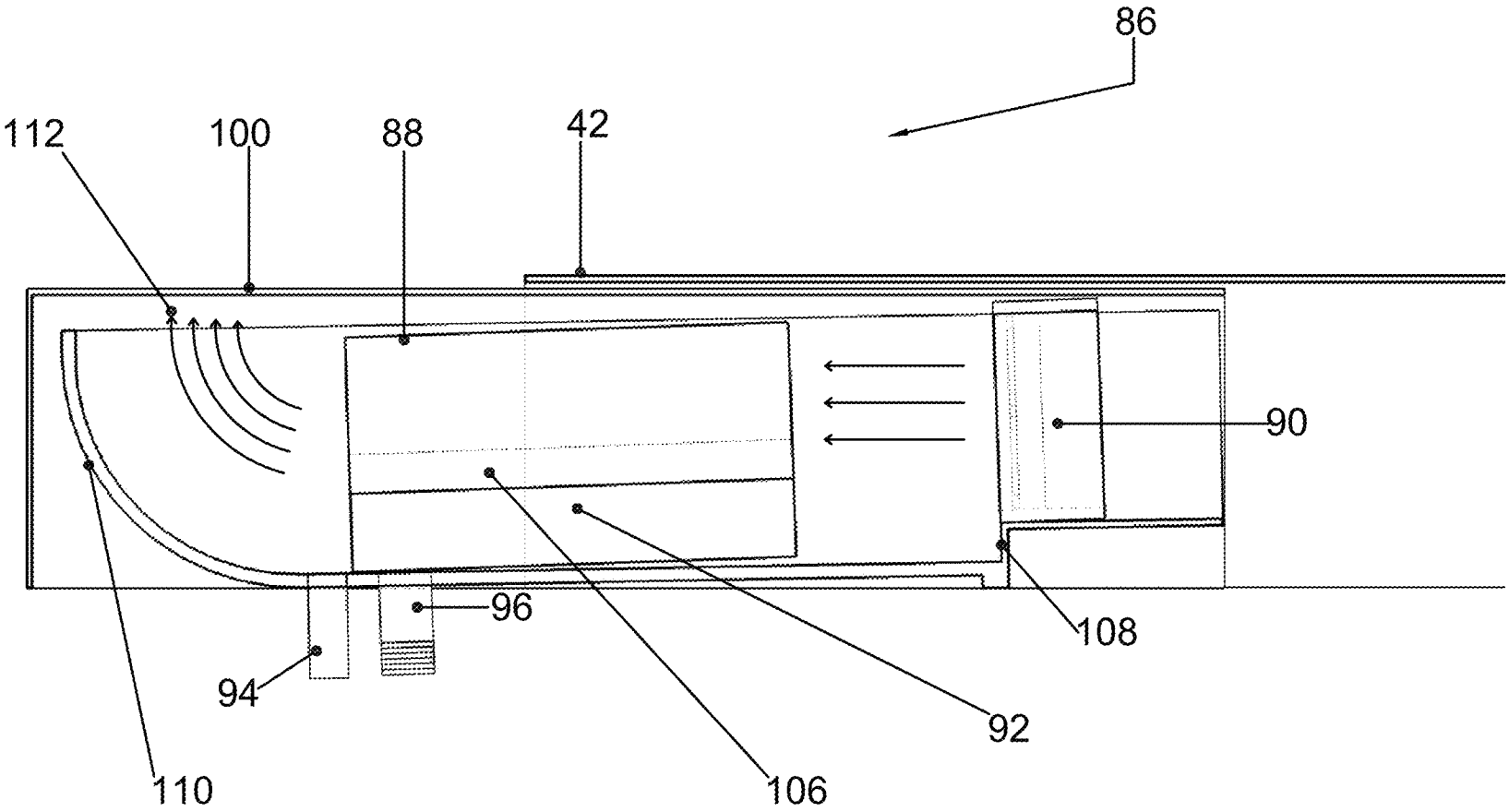
FIG. 15 is a side view of the thermal conditioning module of FIG. 14 shown in an assembled configuration in accordance with an example embodiment of the present disclosure.

In accordance with one example embodiment of the present disclosure, the finned tube heat exchanger 80 is used to prevent the need for a fan and minimize the area needed to provide heat exchange. The finned tube heat exchanger 80 as shown is located by the exterior insulated door 18 inside the structure 16. The drip pan 78 with the compressor discharge can be routed in a serpentine configuration as shown at the bottom thereof and provides the ability to evaporate condensate coming from the drain of the conditioning module 86 (FIGS. 14-15). The drip pan 78 can also encapsulate the finned tube heat exchanger 80, which develops condensate during heating of the secure storage assembly apparatus 10. The finned tube heat exchanger 80 can be relocated to the top of the secure storage assembly apparatus 10 and would require both flex (refrigerant) lines 72 and a drain (not shown) through the sidewalls 84 of the apparatus 10. The reversing valve 74 is configured to switch between cooling and heating modes.

FIG. 14 is an exploded view of the thermal conditioning module 86 of the environmental control mechanism 40 of the secure storage assembly apparatus 10. As shown in the illustrated embodiment, the thermal conditioning module 86 includes the following configuration: a finned heat sink 88, a plurality of muffin fans 90, a machined plate 92, a drain stub 94, tube stubs with male flared fittings 96 secured with sealant 98, pan 100, and a mounting tab 102 on each side of the pan 100. Commercially available aluminum finned heat sink 88 material can be welded to a machined aluminum plate 92. The machined plate 92 can be configured with grooves 104 therethrough that serpentine throughout the plate to provide a flow path for refrigerant to provide heat exchange. Aluminum tube stubs with male flared fittings 96 can be welded to the bottom 106 of the machined plate 92 at the ends of the grooves 104 and provide a means to connect the flex lines 72 (FIG. 13). The welded assembly is placed in the pan 100 after sealant 98 is applied around the openings 99 for the tube stubs 96. The pan 100 collects condensate during the cooling mode and routes it out of the secure storage assembly apparatus 10. The pan 100 also serves as an air duct. The machined plate 92 can be tack welded to the pan 100 on at least a few areas (away from sealant 98) to maintain it in place.

FIG. 15 is a side view of the thermal conditioning module 86 shown in an assembled configuration. As shown in the illustrated embodiment, a continuous perimeter seal weld 106 between the finned heat sink 88 and machined plate 92 is used for a hermitically sealed heat exchanger to prevent leaks of refrigerant to the interior of the secure storage assembly apparatus 10. The refrigerant flex line connection point (not shown) lies outside of the interior of the secure storage assembly apparatus 10. The pan 100 can be configured to include space therearound all four sides of the heat exchanger to allow liquid (e.g., water) to flow to the drain stub 94. A shelf 108 can be included at one end of the pan 100 to keep the fans 90 above any moisture. A turning vane 110 can be configured in the pan 100 to deliver conditioned air 112 to the interior of the secure storage assembly apparatus 10. The perforated sleeve platform 42 (configured as two-pieces) is placed over the environmental control mechanism 40 and serves as the bottom of the secure storage assembly apparatus 10 to the user.

Figure 16:
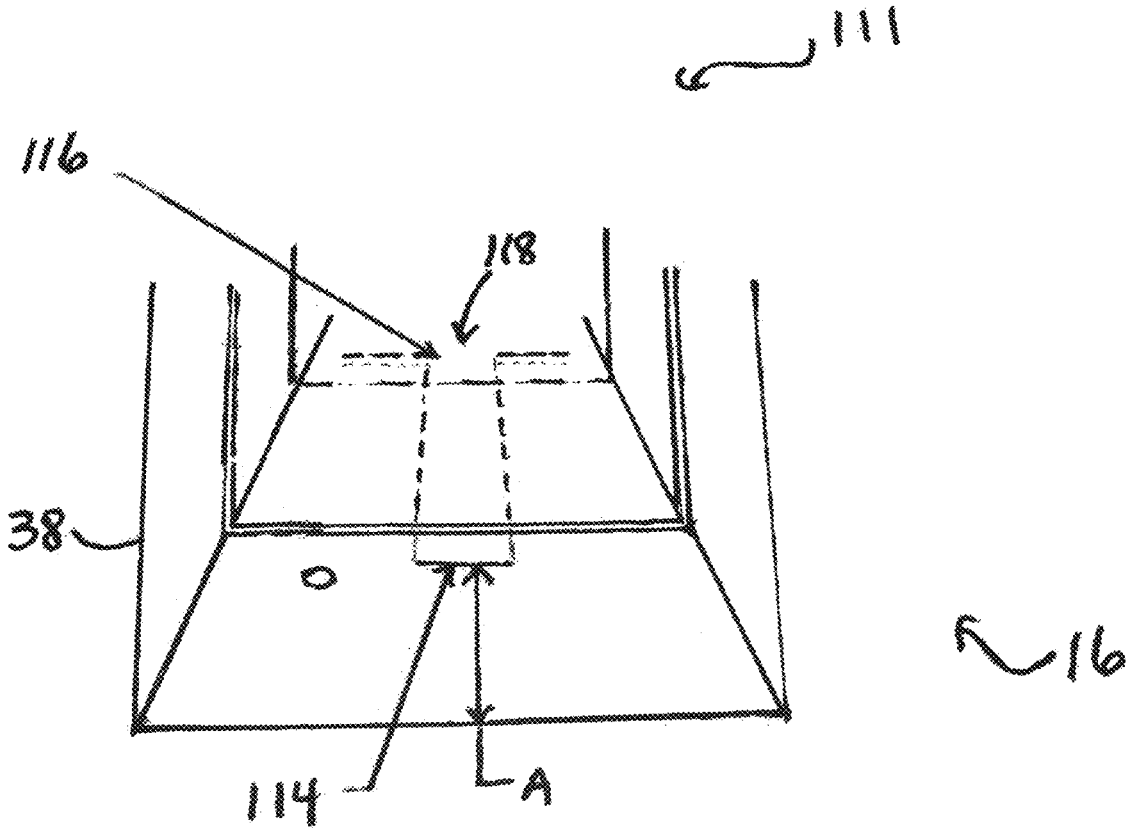
FIG. 16 is a rear view of the secure storage assembly apparatus from an interior of the structure showing a configuration for positioning the thermal conditioning module inside the apparatus at installation without disconnecting refrigerant lines in accordance with an example embodiment of the present disclosure.

FIG. 16 is a rear view of the secure storage assembly apparatus 10 from an interior of the structure 16 showing a configuration 111 for positioning the thermal conditioning module 86 inside the apparatus 10 at installation without disconnecting refrigerant lines. As shown in the illustrated embodiment, a notch 114 is configured on the interior insulated sleeve 38 to allow the temporary passing of the refrigerant lines (not shown) inside the secure storage assembly apparatus 10. Dimension A can be maximized to position the thermal conditioning module 86 to the center of the secure storage assembly apparatus 10, however, said dimension still needs to accommodate the position of the edge of the exterior insulated sleeve 18 at minimum structure wall thickness. It should be understood that at maximum structure wall thickness the thermal conditioning module 86 can cover the notch 112 of long length. An optional removable reinforcement clip 116 at notch opening 118 can be used to improve rigidity of the interior insulated sleeve 38, particularly during shipping. Sealant around final notch opening 118 to bottom of the pan 100 can be used.

Figure 17A:
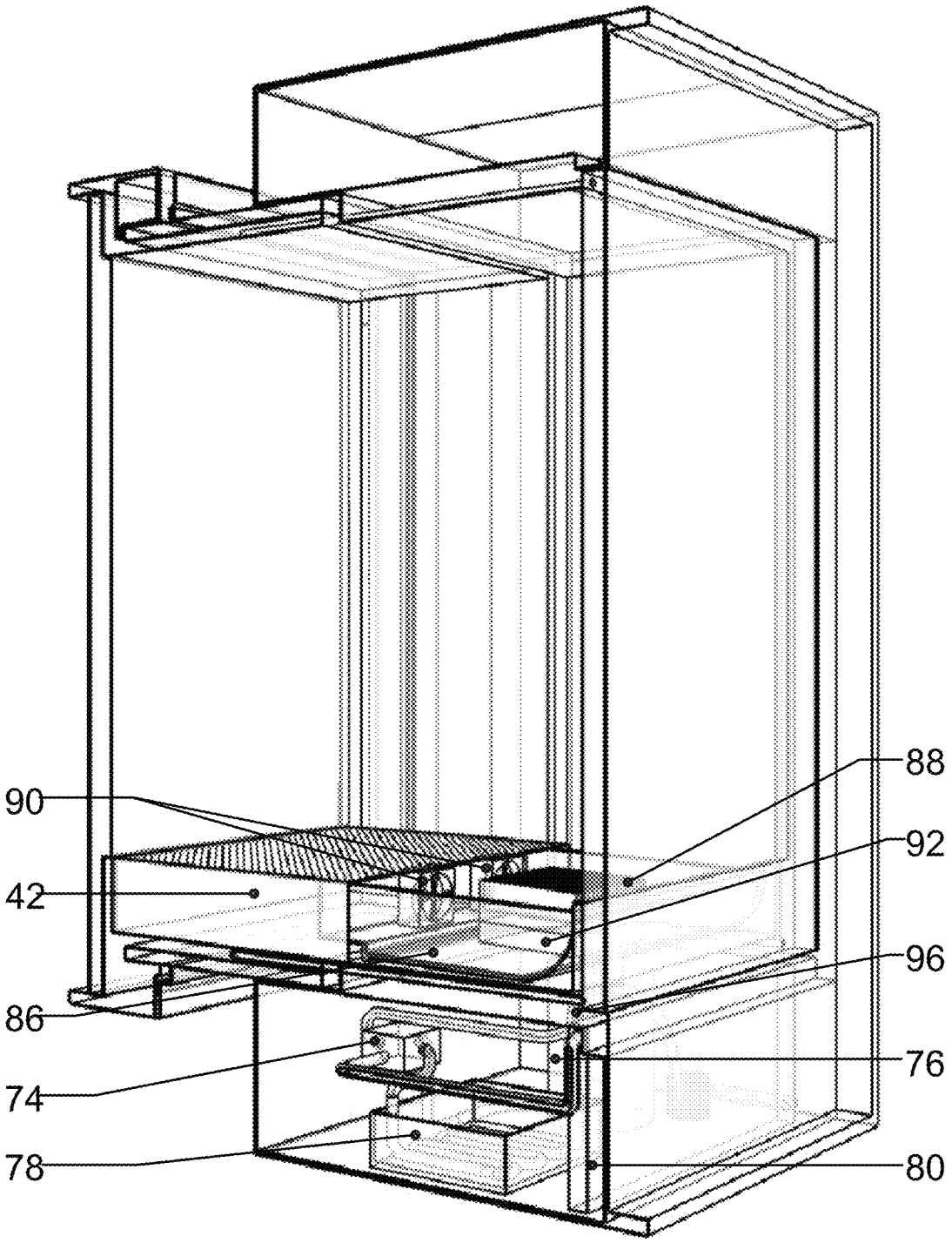
FIG. 17A is a perspective view of the secure storage assembly apparatus with the environmental control mechanism installed therein shown from the interior of the apparatus in accordance with an example embodiment of the present disclosure.
Figure 17B:
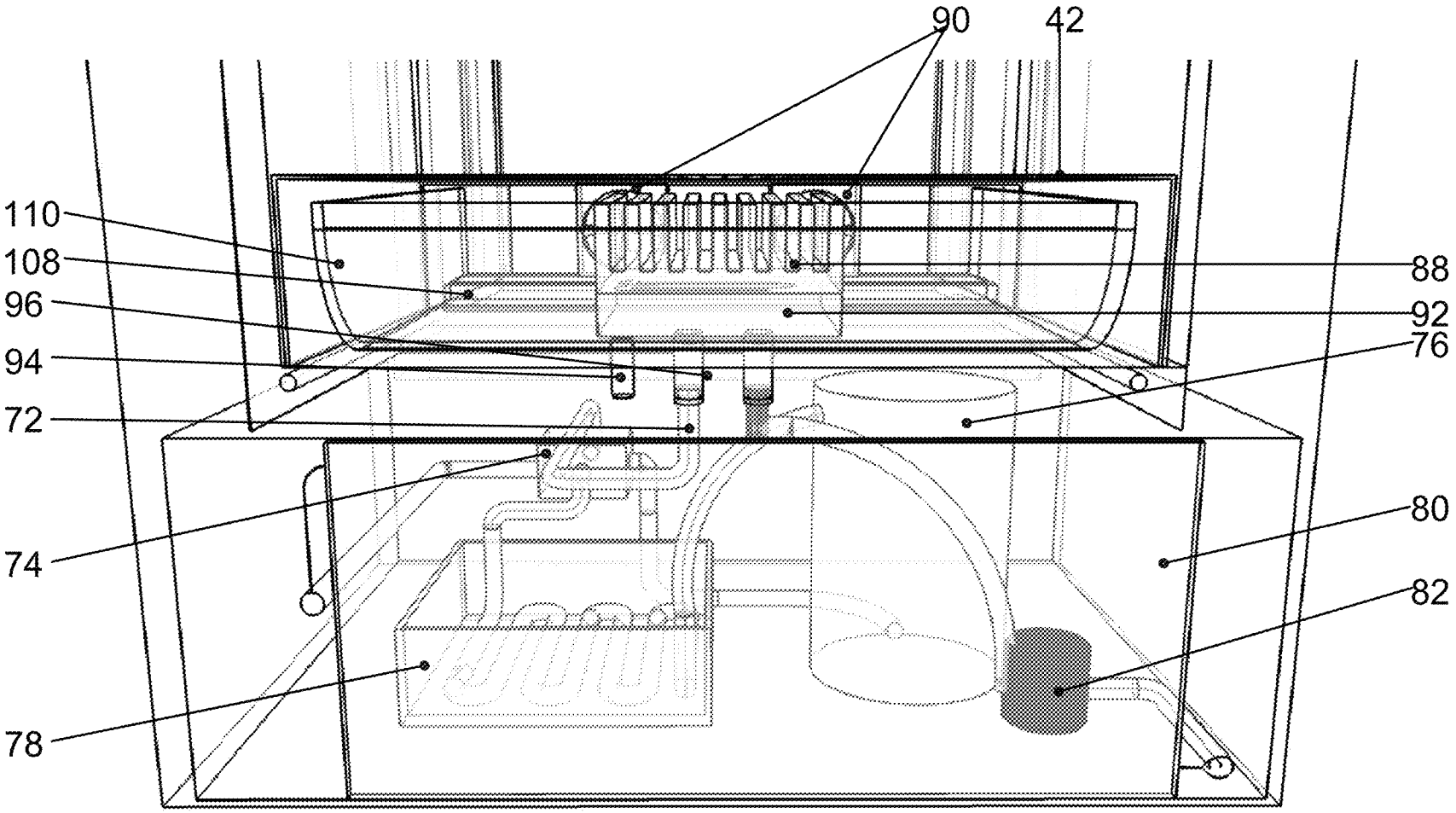
FIG. 17B is an enlarged front view of the environmental control mechanism of the secure storage assembly apparatus shown from the interior of the apparatus in accordance with an example embodiment of the present disclosure.
Figure 17C:
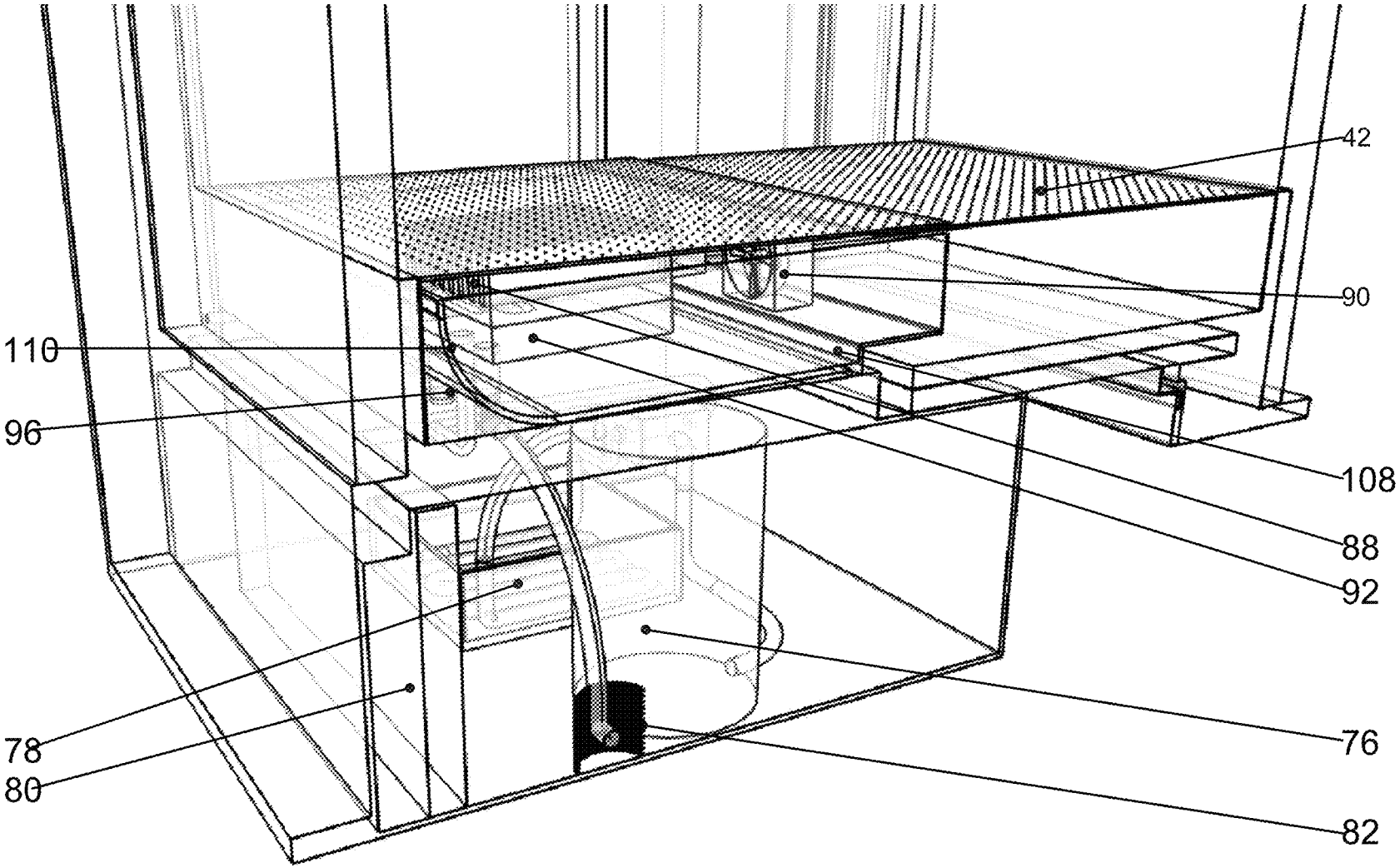
FIG. 17C is an enlarged side view of the environmental control mechanism of the secure storage assembly apparatus shown from the interior of the apparatus in accordance with an example embodiment of the present disclosure.
Figure 17D:
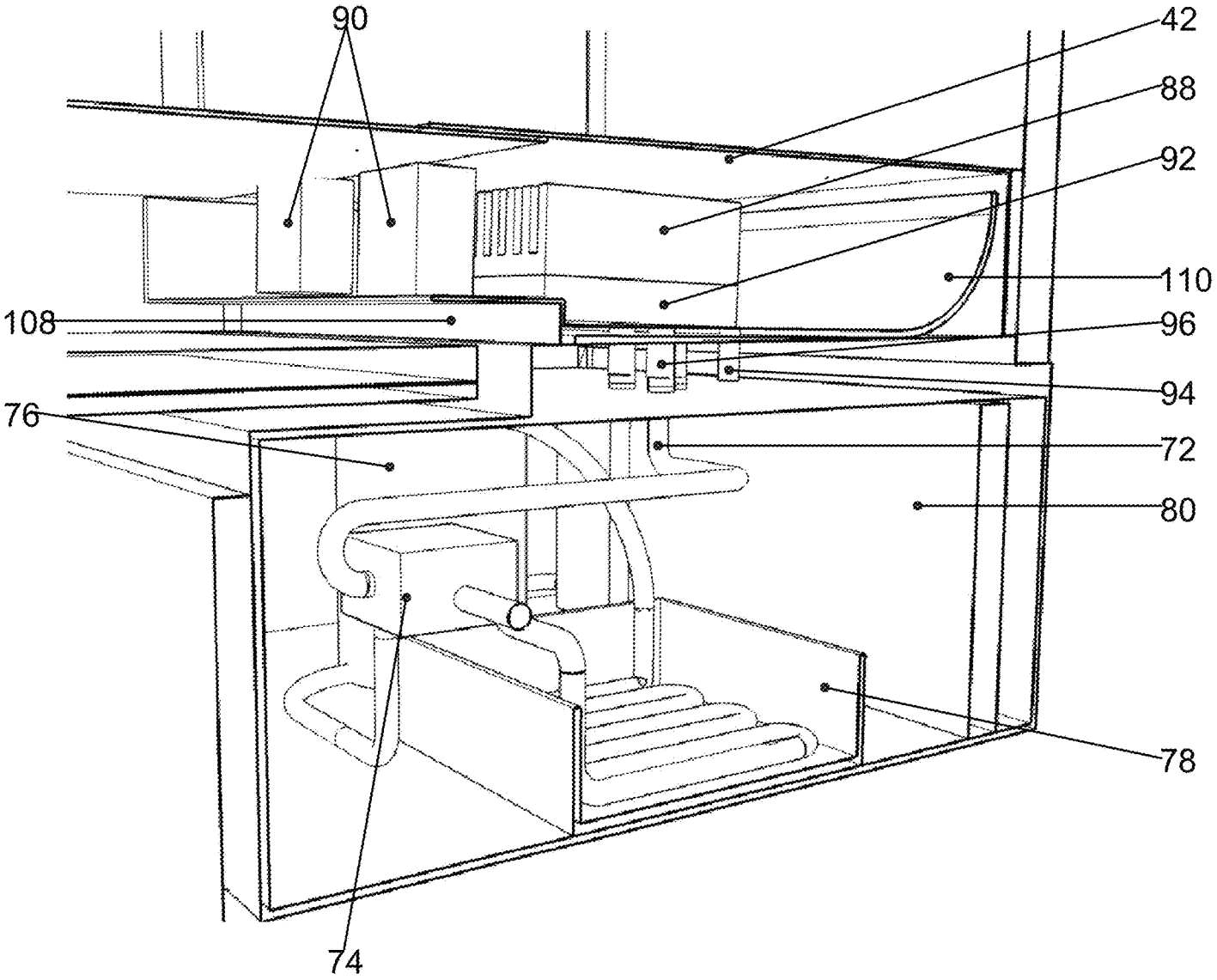
FIG. 17D is an enlarged perspective view of the environmental control mechanism of the secure storage assembly apparatus shown from the interior of the apparatus in accordance with an example embodiment of the present disclosure.
Figure 17E:
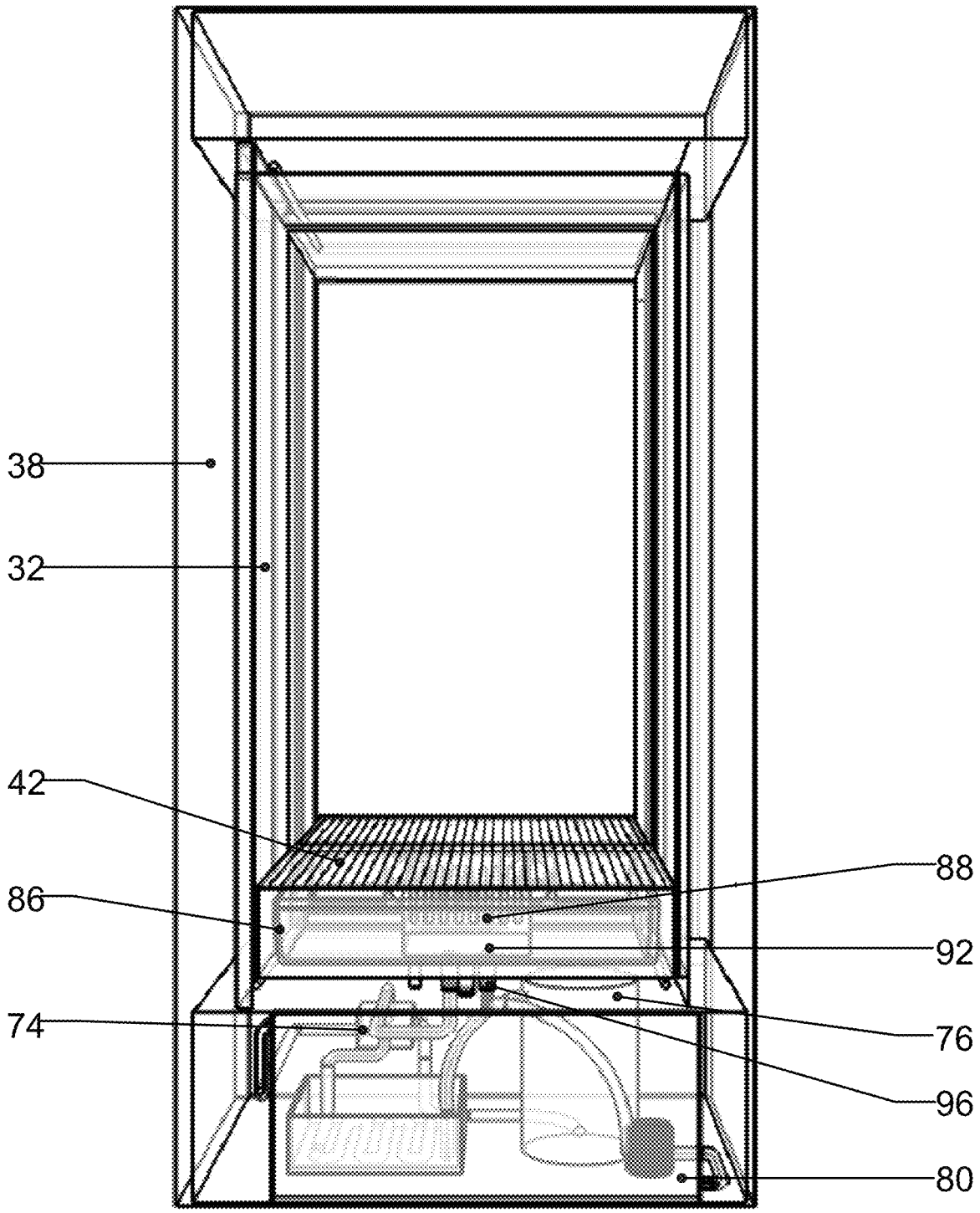
FIG. 17E is a front view of the secure storage assembly apparatus with the environmental control mechanism installed therein shown from the interior of the apparatus in accordance with an example embodiment of the present disclosure.

FIG. 17A is a perspective view of the secure storage assembly apparatus 10 with the environmental control mechanism 40 installed therein shown from the interior of the apparatus 10. FIG. 17B is an enlarged front view of the environmental control mechanism 40 of the secure storage assembly apparatus 10 shown from the interior of the apparatus 10. FIG. 17C is an enlarged side view of the environmental control mechanism 40 of the secure storage assembly apparatus 10 shown from the interior of the apparatus 10. FIG. 17D is an enlarged perspective view of the environmental control mechanism 40 of the secure storage assembly apparatus 10 shown from the interior of the apparatus 10. FIG. 17E is a front view of the secure storage assembly apparatus 10 with the environmental control mechanism 40 installed therein shown from the interior of the apparatus 10.

It should be understood that the various components of the secure storage assembly apparatus 10 can be fabricated of any suitable sturdy materials, such as stainless steel, metal alloys, plastic and the like. The exterior insulated door 12, the interior insulated door 44, the exterior insulated sleeve 18 and the interior insulated sleeve 38 can be insulated with any suitable insulation material, such as foam and the like.

It should be further understood that the various components of the secure storage assembly apparatus 10 can be fabricated in different sizes and shapes and are sized to scale the particular designated area of the structure cut to accommodate the secure storage assembly apparatus installed to the structure. The various components of the secure storage assembly apparatus 10 can be fabricated by any suitable manufacturing process, such as die casting, extrusion, sheet metal forming, 3D printing and the like.

In accordance with the present disclosure, the secure storage assembly apparatus 10 can be configured to have plug and play capability that allows a wide arrangement of electronic sensors and controls. For example, the secure storage assembly apparatus 10 can be linked to a proprietary network or plug into other networks, such as Nest and the like. In addition, the secure storage assembly apparatus 10 can be configured with keyless entry, a 10-digit keypad, Bluetooth communication with parcel and fresh good delivery tracking devices, a camera for allowing access based on facial recognition software, utilize machine learning to use a camera to see with a sensor, and have certification identification for delivery access. Further, the secure storage assembly apparatus 10 can be configured for use with various apps via a customer's smart phone, tablet or other electronic device.

In accordance with the present disclosure, there is further disclosed a method of installing the secure storage assembly apparatus 10 to a structure, such as a customer's home or work premises 16. The method includes the steps of: providing the secure storage assembly apparatus 10 disclosed herein in an unassembled configuration; designating a structure 16 to install the secure storage assembly apparatus 10 thereto; determining a hole cut of a designated area of an exterior wall 14 of the structure 16 as a stud or block frame; cutting the designated area of the exterior wall 14 of the structure 16 to accommodate the secure storage assembly apparatus 10 to be installed thereto; securing the hollow mount box 32 to a plurality of wall studs 11 of the structure 16; installing the exterior insulated sleeve 18 with the exterior insulated door 12 thereon and the at least one flashing panel 28 in direct communication therewith around the first end 48 of the hollow mount box 32; installing the interior insulated sleeve 38 with the at least one environmental control mechanism 40 disposed therein and the interior insulated door 44 thereon around the second end 50 of the hollow mount box 32; connecting the exterior insulated sleeve 18 to the interior insulated sleeve 38 with the hollow mount box 32 secured therebetween via a plurality of fastening screws 45; and setting the at least one perforated sleeve platform 42 over the at least one environmental control mechanism 40.

It should be understood that the hollow mount box 32 can be attached to the plurality of wall studs 11 of the exterior wall 14 of the structure 16 with a continuous weld seal and proprietary plastic flashing 28 such that the hollow mount box is connected inside the waterproof membrane of the building envelope. The hollow mount box 32 is designed to be as watertight as any professionally installed door or window. The plurality of fastening screws 45 connecting the exterior insulated sleeve 18 to the interior insulated sleeve 38 with the hollow mount box 32 secured therebetween are configured to customize the depth of the components to fit a 2 inch to 12 inch wall.

In other embodiments, the method further includes the step of providing a transformer 8 to connect the secure storage assembly apparatus 10 to a power source (not shown). For example, a transformer 8 can connect the 12 volt secure storage assembly apparatus/system to a 120 volt or 240 volt power source installed by a technician, hard-wired inside the interior insulated sleeve or an electrical wipe can be surface mounted to the nearest electrical outlet.

The installation method of the secure storage assembly apparatus 10 is determined as a stud or block frame, which determines the hole cut of the designated area of the structure. In the case of a stud frame, a 1½ inch surround cut is made. In the case of a block frame, a ¼ inch surround cut is made. The secure storage assembly apparatus 10 accommodates thin walls for temporary trailers and offices, 2×4 walls, 6-inch typical custom home framing and up to 12 inches of concrete tilt of industrial buildings. Further, the secure storage assembly apparatus 10 interfaces with all building construction types.

These and other advantages of the present disclosure will be apparent to those skilled in the art. Accordingly, it will be recognized by those skilled in the art that changes or modifications may be made to the above-described embodiments without departing from the broad inventive concepts of the present disclosure. It should therefore be understood that the present disclosure is not limited to the particular embodiments described herein, but is intended to include all changes and modifications that are within the scope and spirit of the disclosure as encompassed by the disclosure and figures herein and the following claims.

What is claimed:

1. A secure storage assembly apparatus for the delivery of goods to a premises, comprising:

an exterior insulated door configured to have a locking mechanism and opened from an exterior of the premises;

an exterior insulated sleeve having an inner surface with an upper flange and a lower flange extending outwardly therefrom, the exterior insulated sleeve having an outer surface for receiving the exterior insulated door thereon;

at least one flashing panel configured to be attached to the upper flange and the lower flange of the exterior insulated sleeve, the at least one flashing panel having a drip edge positioned thereunder;

a hollow mount box having a weatherproof gasket extending therearound an outer surface thereof, the hollow mount box configured to be attached to the premises;

an interior insulated sleeve configured to house at least one environmental control mechanism;

at least one perforated sleeve platform configured to cover the at least one environmental control mechanism disposed in the interior insulated sleeve; and an interior insulated door configured to be received on an outer surface of the interior insulated sleeve such that the interior insulated door is opened from the interior of the premises;

wherein the hollow mount box is configured to receive the exterior insulated sleeve at a first end and the interior insulated sleeve at a second end with the at least one flashing panel disposed between the hollow mount box and the exterior insulated sleeve when installed to the premises.

2. The secure storage assembly apparatus of claim 1, wherein the exterior insulated sleeve is connected to the interior insulated sleeve with the hollow mount box secured therebetween via a plurality of fastening screws for tamper-proof security.

3. The secure storage assembly apparatus of claim 1, wherein the hollow mount box is secured to a plurality of wall studs of an exterior wall of the premises via a plurality of fin screws.

4. A method of installing a secure storage assembly apparatus to a structure, the method comprising the steps of:

providing the secure storage assembly apparatus in an unassembled configuration, the secure storage assembly apparatus comprising:

an exterior insulated door configured to have a locking mechanism and opened from an exterior of the structure;

an exterior insulated sleeve having an inner surface with an upper flange and a lower flange extending outwardly therefrom, the exterior insulated sleeve having an outer surface for receiving the exterior insulated door thereon;

at least one flashing panel configured to be attached to the upper flange and the lower flange of the exterior insulated sleeve, the at least one flashing panel having a drip edge positioned thereunder;

a hollow mount box having a weatherproof gasket extending therearound an outer surface thereof, the hollow mount box configured to be attached to the premises;

an interior insulated sleeve configured to house at least one environmental control mechanism;

at least one perforated sleeve platform configured to cover the at least one environmental control mechanism disposed in the interior insulated sleeve; and an interior insulated door configured to be received on an outer surface of the interior insulated sleeve such that the interior insulated door is opened from the interior of the premises;

designating the structure to install the secure storage assembly apparatus thereto;

determining a hole cut of a designated area of an exterior wall of the structure as a stud or block frame;

cutting the designated area of the exterior wall of the structure to accommodate the secure storage assembly apparatus to be installed thereto;

securing the hollow mount box to a plurality of wall studs of the exterior wall of the structure;

installing the exterior insulated sleeve with the exterior insulated door thereon and the at least one flashing panel in direct communication therewith around the first end of the hollow mount box;

installing the interior insulated sleeve with the at least one environmental control mechanism disposed therein and the interior insulated door thereon around the second end of the hollow mount box;

connecting the exterior insulated sleeve to the interior insulated sleeve with the hollow mount box secured therebetween via a plurality of fastening screws; and setting the at least one perforated sleeve platform over the at least one environmental control mechanism.

5. The method of claim 4 further comprising the step of: providing a transformer to connect the secure storage assembly apparatus to a power source.

* * * * *